United States Patent [19]

Zavitsanos et al.

[11] 4,152,120

[45] May 1, 1979

[54] COAL DESULFURIZATION USING ALKALI METAL OR ALKALINE EARTH COMPOUNDS AND ELECTROMAGNETIC IRRADIATION

[75] Inventors: Peter D. Zavitsanos, Norristown; Kenneth W. Bleiler, Hatboro; Joseph A. Golden, Pennsburg, all of Pa.

[73] Assignee: General Electric Company, Philadelphia, Pa.

[21] Appl. No.: 875,057

[22] Filed: Feb. 6, 1978

[51] Int. Cl.[2] ..... C10L 9/10; C10B 57/00

[52] U.S. Cl. ..... 44/1 R; 201/17

[58] Field of Search ..... 44/1 R; 201/17

[56] References Cited

U.S. PATENT DOCUMENTS

| | | | |
|---|---|---|---|
| 3,387,941 | 6/1968 | Murphy et al. | 201/17 X |
| 3,472,622 | 10/1969 | Ridley | 201/17 X |
| 3,993,455 | 11/1976 | Reggel et al. | 44/1 R |
| 4,054,420 | 10/1977 | Longanbach | 44/1 R |
| 4,076,607 | 2/1978 | Zavitsanos et al. | 44/1 R |

*Primary Examiner*—Carl Dees

*Attorney, Agent, or Firm*—Stephen A. Young

[57] ABSTRACT

Pyritic and organic sulfur is removed from pulverized coal by contacting the coal with an alkali metal or alkaline earth compound and thereafter using low amounts of electromagnetic energy to preferentially heat sulfur rich regions of the coal-alkali compound mixture. The alkali compound reacts with the sulfur within the coal to form water soluble, or separated compounds of sulfur which can easily be removed by washing the treated coal with water and/or to form compounds which do not convert into sulfur oxides during combustion of the coal.

15 Claims, 2 Drawing Figures

COAL DESULFURIZATION USING ALKALI METAL OR ALKALINE EARTH COMPOUNDS AND ELECTROMAGNETIC IRRADIATION

BACKGROUND OF THE INVENTION

This invention relates to a process for desulfurization of coal, and more particularly, relates to desulfurization of coal using electromagnetic energy and alkali metal or alkaline earth compounds.

Carbonaceous aggregates, generally comprising coal, is a plentiful energy resource in the United States and its increased utilization is vital to meeting the nation's present and future energy needs. Despite these vast coal reserves, troublesome problems arise from an environmental standpoint in using much of this coal because of its high sulfur content. When burned, the sulfur contained in the coal is released into the atmosphere as sulfur dioxide.

Current government regulations limit sulfur dioxide emissions for coal combustion to 1.2 pounds of $SO_2$ for each 1,000,000 BTU of energy produced. For a 12,000 BTU/pound coal, the above standard limits the total sulfur content to a maximum of about 0.7 weight percent. Chemical analyses on coal deposits from different geographic regions across the United States indicate that this pollutant level limitation eliminates direct utilization of most Eastern and Midwestern coals, which represent up to 40 percent of the total United States reserves.

Sulfur does not exist in coal in its elemental form; instead it exists in chemical combination with (a) the organic compounds in the coal, (b) iron as pyrite ($FeS_2$) and/or (c) calcium or iron as a sulfate. These are respectively referred to as "organic," "pyritic" and "sulfate" sulfur. The sulfate sulfur is usually present in quantities less than 0.05% and is therefore not an important factor.

Organic sulfur in coal is chemically bound to the organic structure. Typical compounds involved are assumed to be the disulfides, thiophene rings, thioethers, disulfides, and mercaptans. Organic sulfur has been shown to be the most difficult type of sulfur to remove from coal. Pyritic sulfur is present in the form of a dispersion of particles which have the chemical composition $FeS_2$. The size and form of these particles varies greatly from seam to seam and even within a given chunk.

In order to meet existing government regulations on sulfur dioxide emission, it is necessary that both pyritic and organic sulfur be removed from coal. Several prior art methods have been proposed for removing sulfur from coal compounds. These range from physical processes for separation of pyritic sulfur compounds to removal of both pyritic and organic sulfur using high pressure/high temperature chemical processes which employ chemical solvents and long treatment times. However, in general, such prior art methods have proven to be too expensive and inefficient or fail to remove both pyritic and organic sulfur in sufficient quantities to permit the treated coal to be burned consistent with current government regulations.

Prior art methods for removal of pyritic sulfur include gravity and magnetic separation techniques as well as chemical treatment techniques such as the Meyers process which treats coal with a ferric sulfate solution in an autoclave at elevated temperature and pressure for a duration in excess of ten hours to produce elemental sulfur and iron sulfate which are then removed from the coal.

Other prior art methods for removal of organic sulfur include (1) treating the coal at room temperature with a 3% solution of hydrogen peroxide, (2) reacting the coal with pressurized hydrogen and a solvent of anthracene oil at high temperature (400° C.), and (3) reacting the coal at high pressure (200 atm) and temperature (352° C.) with sodium hydroxide for a duration of thirty minutes.

Another prior art method for coal desulfurization is disclosed in U.S. Pat. No. 4,076,607 issued Feb. 28, 1978, by Peter D. Zavitsanos et al and assigned to the assignee of the present invention. In the process described in the Zavitsanos et al application, crushed coal is irradiated with microwave energy to induce thermochemical, in-situ, reactions to liberate sulfur in the form of stable gaseous species such as $H_2S$, COS and $SO_2$. This process has shown to be effective in removing up to 50% of sulfur from coal samples containing high levels of pyritic sulfur. However, this process is significantly less effective in desulfurization of coal having a high organic sulfur content. The present invention improves on the method disclosed in the aforementioned Zavitsanos application by permitting the removal of larger amounts of sulfur from the coal compounds and in particular in removing larger amounts of organic sulfur.

OBJECT OF THE INVENTION

Thus, it is a primary object of this invention to provide an inexpensive yet efficient process for removal of large quantities of sulfur from coal.

It is a further object of this invention to provide an improved process for removing both pyritic and organic sulfur from coal.

SUMMARY OF THE INVENTION

These and other objects are achieved in the preferred embodiment of this invention in which in-situ thermochemical reactions between pyritic and organic sulfur within pulverized coal compounds and added alkali metal or alkaline earth compounds is induced by irradiating the coal alkali or alkaline compound mixture with electromagnetic energy. Sulfur rich regions within the coal compounds preferentially absorb the electromagnetic energy inducing the localized thermochemical reactions which produce water soluble or other separated sulfur compounds. Most of the produced sulfur compounds are then removed by washing the treated coal with water. Other produced sulfur compounds are of the type which do not convert into sulfur oxides during combustion of the coal.

DESCRIPTION OF THE PREFERRED EMBODIMENT

Figure 1:
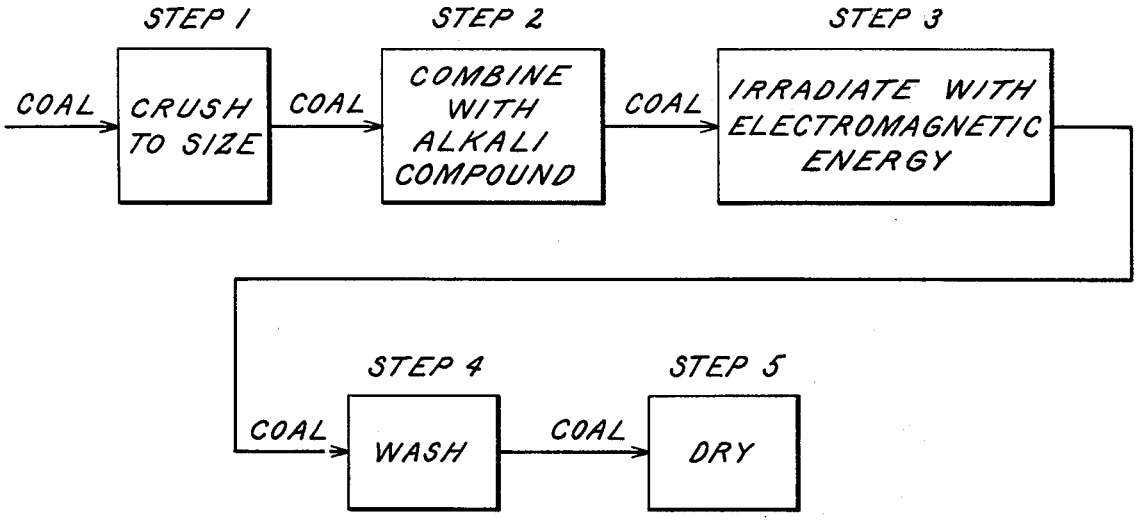
FIG. 1 is a schematic diagram in block format illustrating the process steps of this invention.

Referring to FIG. 1, therein is shown a schematic diagram in block format of the process steps of this invention. In step 1, coal is initially pulverized to a desired size. A preferred size is to an approximate average diameter within a range of 0.005 centimeters to 5 centimeters. Next in step 2, the coal is contacted with an alkali metal or alkaline earth compound by leaching or any other suitable process. While all alkali metal or alkaline earth compounds are useful for this purpose preferred compounds include NaOH, $Na_2CO_3$, LiOH, $Li_2CO_3$, KoH, $K_2CO_3$, CaO and $Ca(OH)_2$. The alkali metal or alkaline earth compound can be introduced either as a powder well mixed with the coal, or as a concentrated solution, preferably 20% by weight, which results in the formation of a slurry. The preferred method is by forming a slurry. The slurry can be treated directly or dried before performing the next process step. However, it is essential that there be intimate mixing of the alkali metal or alkaline earth compound with the coal before the next process step is performed. After contacting the coal with the alkali metal or alkaline earth compound in step 3, the coal is irradiated with electromagnetic energy in order to stimulate in-situ thermo-chemical reactions between the alkali metal or alkaline earth compound and pyritic and organic sulfur within the pulverized coal compounds. Tests have demonstrated that the presence of the alkali metal or alkaline earth compounds permit desulfurization at much lower frequencies for the electromagnetic radiation than required without its use. A wide range of frequencies of electromagnetic energy are possible to be used with this process. Frequencies ranging between 1 MHZ up to 50 GHZ may be used to desulfurize coal compounds. However, frequencies in the microwave band are preferred. The duration of application of the electromagnetic energy and the particular frequency to be used will depend upon the particular alkali metal or alkaline earth compound used, the type, size and sulfur content of the coal and the amount of sulfur it is desired to remove. These parameters for any particular variety of coal are best determined by experimentation. Both pulsed and continuous wave electromagnetic energy are suitable. The power required to induce the in-situ thermo-chemical reactions will depend upon the amount, type and average size of the coal to be irradicated as well as the particular alkali metal or alkaline earth compound used. In any event, however, the required energy represents a small fraction of the heating value of the coal.

Normally, high thermal energy in a range of about 600°-900° C. is required to break bonded constituents of the coal (i.e., Fe-S and C-S). However, the process of this invention by depositing electromagnetic energy in a manner to selectively heat compounds in coal that contain large amounts of highly reactive sulfur, uses significantly less energy. Rapidly exciting the sulfur containing compounds induces thermo-chemical, in-situ, reactions between sulfur compounds and the alkali metal or alkaline earth compounds and thereby breaks the bonds of sulfur-iron and sulfur-carbon under non-equilibrium conditions requiring relatively low bulk temperatures. While the improved desulfurization resulting from the application of electromagnetic energy is not fully understood, it is believed that the high in depth heating rate caused by the application of electromagnetic energy breaks down the coal matrix permitting the alkali metal or alkaline earth compound to contact and react to a greater degree with the sulfur containing interior regions of the coal matrix. Further, the applied electromagnetic energy is preferentially absorbed by the pyritic sulfur within the coal causing it to detach from the coal matrix and react to a greater degree with the alkali metal or alkaline earth compound. The heating energy generated by the electromagnetic energy per gram that is required to induce the in-situ reaction is about 100 calories/gram; this is to be compared to the 1700 calories/gram which is lost when coal is heated to around 800° C. for thermal removal of the sulfur. Thus, during the reaction of the coal and alkali metal or alkaline earth compound, the bulk temperature of the coal rises to a modest level (i.e. less that 350° C.) with no significant loss in heating value.

Referring to Table 1, below, therein is shown the characteristics of four types of coal samples numbers 1 through 4 which were processed in accordance with the method of this invention. The results of this processing as well as the particular process parameters used is shown in Table 2 below. As can be seen from examination of Table 2, the process of this invention is effective in removing over 50% the sulfur content from most processed coal samples in the first forty seconds of irradiation time.

TABLE 1

Nominal Composition and Characteristics of Selected Coals

| Sample No. | Coal Type | % Moisture | % Ash | % Fixed Carbon | Calorific Value Btu/lb. | % Pyritic Sulfur | % Sulfate Sulfur | % Organic Sulfur | Total Sulfur |
|---|---|---|---|---|---|---|---|---|---|
| 1 | Kentucky-Seam#11 | 6.34 | 15.6 | 44 | 11,000 | 0.02 | 0.14 | 4.49 | 4.65 |
| 2 | Kentucky-Seam#9 | 6.11 | 8.4 | 48 | 12,300 | 0.03 | 0.06 | 3.80 | 3.89 |
| 3 | Pennsylvania-Pittsburgh Seam | 2.79 | 22.5 | 44.4 | 11,600 | 2.27 (dry) | 0.01 (dry) | 0.34 (dry) | 2.62 |
| 4 | Pennsylvania (Clarion County) | * | * | * | 13,400 | * | * | * | 2. (mostly pyritic) |
| 5 | Lower Kittanning | * | * | * | * | 4.49 | 0.03 | 0.78 | 5.3 |

*-Not measured
(dry)-Indicates quantity measured after moisture removed

Table 2

PROCESSED COAL SAMPLES

| Sample No.** | Form | Particle Size | Additive | Frequency in Hz | Exposure Time (in Sec) | % Sulfur Removal | % Calorific Value Loss |
|---|---|---|---|---|---|---|---|
| 1 | Slurry Dried (to 20% $H_2O$) | 60-100 mesh | 16% NaOH | $2.45 \times 10^9$ | 30 | 55 | * |
| 1 | " | " | " | " | 40 | 57 | * |
| 1 | " | " | " | " | 80 | 76 | 0 |
| 1 | " | " | " | " | 90 | 75 | * |
| 1 | " | " | " | " | 90 | 85 | * |
| 2 | " | " | " | " | 30 | 40 | 0.6 |

Table 2-continued

| PROCESSED COAL SAMPLES | | | | | | | |
|---|---|---|---|---|---|---|---|
| Sample No.** | Form | Particle Size | Additive | Frequency in Hz | Exposure Time (in Sec) | % Sulfur Removal | % Calorific Value Loss |
| 2 | " | " | " | " | 60 | 56 | * |
| 2 | " | " | " | " | 90 | 72 | * |
| 2 | " | " | " | " | 90 | 73 | * |
| 1 | Slurry | 100–200 mesh | " | $8.3 \times 10^9$ | 20 | 70 | * |
| 1 | Slurry Dried (to 20% $H_2O$) | " | " | " | 20 | 77 | * |
| 1 | Slurry | " | " | " | 30 | 67 | * |
| 1 | " | " | " | " | 30 | 70 | * |
| 1 | Slurry Dried (to 20% $H_2O$) | " | " | " | 30 | 70 | * |
| 1 | NaOH Powder | " | " | " | 30 | 57 | * |
| 2 | NaOH Powder | " | " | " | 30 | 30 | * |
| 1 | Slurry | " | " | " | 20 | 70 | * |
| 1 | " | " | " | " | 20 | 75 | * |
| 1 | " | " | " | " | 30 | 71 | * |
| 1 | " | " | " | " | 30 | 78 | * |
| 1 | " | " | " | " | 30 | 85 | * |
| 1 | Slurry Dried (to 20% $H_2O$) | " | " | " | 30 | 67 | * |
| 1 | " | " | " | " | 30 | 70 | * |
| 4 | Slurry Dried (to 20% $H_2O$) | " | " | " | 20 | 60 | 11 |
| 4 | " | " | " | " | 30 | 63 | * |
| 3 | " | " | " | " | 30 | 50 | 0.2 |
| 5 | " | " | " | " | 30 | 40 | * |
| 3 | " | " | " | $22 \times 10^6$ | 20 | 37 | * |
| 5 | " | " | " | " | 20 | 39 | * |

*indicates quantity not measured
**refers to sample of identical number as described in Table 1

After irradiation with microwave energy the coal, as illustrated in step 4 of FIG. 1 is washed, preferably with water, to remove the separated sulfur compounds. Sulfur removal when NaOH is used as the alkali metal compound is based on the attack of sulfur by hot NaOH to form sodium bisulfide ($Na_2S$) and sodium polysulfides ($Na_2S_n$), the chemical reaction is as follows:

$$A\ NaOH + B\ S(bound) \rightarrow X\ Na_2S + Y\ NaOH.$$

Bound in the above reaction means sulfur bound to iron (as a pyrite) or sulfur organically bound to carbon and A,B,X,Y, and n are integer numbers required to balance the equation. Most of the sodium bisulfide and polysulfides are dissolved in the water during the washing process. The required time to complete sulfur removal to less than 0.7% by weight ranges from 30 to 60 seconds depending on the type of coal, its sulfur content and the particular alkali metal or alkaline earth compound used.

Elemental sulfur may be recovered from the water solution used to wash the coal by the addition of $CO_2$ or acid to the water solution to form $H_2S$. The $H_2S$ may then be converted to elemental sulfur using processes well known in the art.

It has also been found that even greater amounts of sulfur may be removed by multiple treatment of the coal. For multiple treatment, after sulfur removal in accordance with steps 1 through 4 of FIG. 1, steps 2 through 4 of FIG. 1 are repeated. Table 3 below illustrates the coal type and process parameters for various coal samples double treated in accordance with the multiple treatment method of this invention. As can be seen from table 3 in excess of 90% of sulfur may be removed with less than 30 seconds electromagnetic irradiation time for each treatment interval. It is of course possible to retreat the coal as many times as desired to remove even greater quantities of sulfur.

Table 3

| Processed Coal Samples Double Exposure Runs (Involving Two 30 Sec. Exposures) | | | | | | | |
|---|---|---|---|---|---|---|---|
| Sample No.** | Form | Particle Size | Additive | Frequency in Hz | Exposure Time (in Sec.) | % Sulfur Removal | % Calorific Value Loss |
| 1 | Slurry | 100–200 mesh | 16% NaOH | $22 \times 10^6$ | 60 | 95 | 3 |
| 1 | " | " | " | " | 60 | 97 | * |
| 1 | " | " | " | " | 60 | 98 | * |
| 1 | Slurry Dried (to 20% $H_2O$) | " | " | " | 60 | 95 | * |
| 3 | " | " | " | " | 60 | 85 | * |
| 5 | " | " | " | " | 60 | 80 | * |

*indicates quantity not measured
**refers to sample of identical number as described in Table 1

As can be seen from examination of Tables 2 and 3, the desulfurization level shows a maximum as a function of elasped irradiation time. While the exact reason for this phenomenon is not known, it is believed that prolonged treatment beyond an optimum time produces polysulfides or elemental sulfur within the coal which are insoluble in water and consequently not removed during the washing operation, thus, effectively reducing the effectiveness of the treatment. It is for this reason, that a multiple treatment approach is preferred over long irradiation times where a high degree of sulfur removal is required.

Tables 2 and 3 also show the measured loss in heating value for several of the various types of coal samples treated in accordance with the method of this invention. As can be seen from examination of these tables, large percentages of sulfur may be removed using the process of this invention with relatively small heating value loss.

Figure 2:
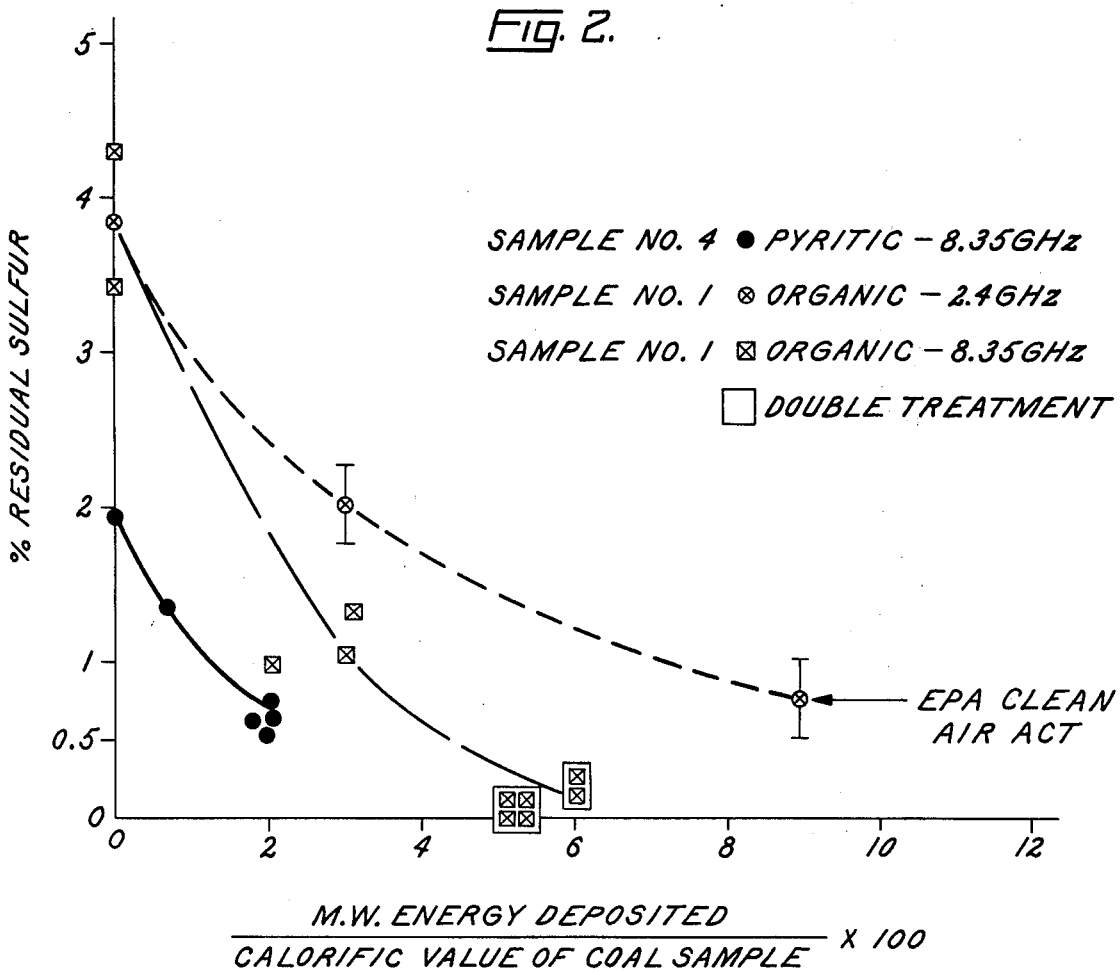
FIG. 2 is a graph illustrating the energy requirements for the method of this invention.

Referring to FIG. 2 therein is shown a graph illustrating the energy requirements for the process of this invention. This graph plots the percentage of residual sulfur as a function of the electromagnetic energy used and the measured calorific value for several coal samples processed as shown in Tables 2 and 3. This graph illustrates that the process of this invention can be used to reduce the sulfur content of coals containing pyritic and/or organic sulfur to below 0.7% by weight with an energy expenditure of 2 to 4 percent of the heating value of the coal. In addition, it appears that the sulfur content can be reduced to a near zero value with an energy consumption of 6% or less of the coal energy content.

After washing, the coal may be dried by permitting it to stand in air or by the use of other well known drying mechanisms such as blow drying. The dried coal may then be used as is or further processed as required for its particular application.

Various changes could be made in the disclosed coal desulfurization method without departing from the scope of this invention.

Thus, while desulfurization of coal in accordance with the teachings of this invention, is preferably practiced in a batch process, it however, is not limited to a batch process. It is within the realm of one skilled in the art to devise apparatus for practicing the method of this invention in a continuous process such as by using a conveyor belt, gravity or a fluidized bed. Similarly, while irradiation with microwave energy is preferred, it is also possible to use electromagnetic energy at frequencies substantially less than microwave. Further, while this process is particularly suited for desulfurization of coal it may be used for desulfurization of other petrochemical products such as coke including petroleum coke, and oil shale. The terms coal and carbonaceous aggregates as used herein is intended to include such other petro-chemical products. Also, while it is preferred that the carbonaceous aggregates be crushed to size to enhance sulfur removal, it is also possible to treat uncrushed carbonaceous aggregates in accordance with the method of this invention and obtain sulfur removal. Other preferred alkali compounds useful for this process include $Na_2S$ and higher order sulfides of sodium.

Therefore, having described a preferred embodiment of this invention through not exhaustive of all equivalents, what is desired to be secured by Letters of Patent of the United States is claimed below:

1. A process for removing pyritic and organic sulfur from carbonaceous aggregates, which comprises the steps of:
   (a) contacting said aggregates with an alkali metal compound or an alkaline earth compound,
   (b) irradiating said contacted aggregates with electromagnetic energy for a duration sufficient to release chemically bonded sulfur within said aggregates and cause said sulfur to react with said alkali metal or alkaline earth compounds, and
   (c) removing the compounds formed by the reaction of the organic and pyritic sulfur with alkali metal or alkaline earth compound from said aggregates.

2. The process of claim 1 further comprising the step of crushing said aggregates to a predetermined average size prior to contacting with said alkali metal or alkaline earth compound.

3. The process of claim 1 wherein said alkali metal compound is selected from the group comprising: $NaOH$, $Na_2CO_3$, $LiOH$, $Li_2CO_3$, $KOH$, $K_2CO_3$, $CaO$ and $Ca(OH)_2$.

4. The process of claim 1 wherein said compounds formed by the reaction of sulfur and the alkali metal or alkaline earth compounds is removed by washing said aggregates with water.

5. The process of claim 4 further comprising the step of drying the washed aggregates.

6. The process of claim 1 wherein said irradiated electromagnetic energy lies in the frequency range between 1 MHZ and 50 GHZ.

7. The process of claim 1 wherein said aggregates are irradiated with electromagnetic energy for a duration between 1 and 90 seconds during said irradiation step.

8. The process of claim 1 wherein the alkali metal or alkaline earth compound comprises a dry powder which is throughly mixed with the crushed aggregates.

9. The process of claim 1 wherein the alkali metal or alkaline earth compound comprises a 20% by weight solution which is mixed with the aggregate during said contacting step to form a slurry.

10. The process of claim 1 further comprising the steps of:
   (a) recontacting said washed aggregate with said alkali metal or alkaline earth compound,
   (b) reirradiating said aggregate with electromagnetic energy,
   (c) rewashing said aggregate, and
   (d) repeating steps (a) through (c) until a desired level of sulfur removal has been achieved.

11. The process of claim 1 wherein said aggregates are maintained at a pressure of 1 atmosphere or less.

12. The process of claim 2 wherein said aggregates are crushed during said crushing step to an approximate average diameter within a range of 0.005 centimeters to 5 centimeters.

13. The process of claim 1 wherein said alkali metal compound is $Na_2S$ or a higher order sulfide of sodium.

14. The process of claim 9 wherein said slurry is dried prior to irradiation.

15. The process of claim 1, wherein the temperature of the aggregates is less than 350° C.

* * * * *